United States Patent [19]

Redenbarger et al.

[11] 4,431,364

[45] Feb. 14, 1984

[54] SELF-LEVELING LINKAGE ASSEMBLY FOR MATERIAL HANDLING EQUIPMENT

[75] Inventors: Philip D. Redenbarger, Centerpoint; Robert A. Fowler, Danville, both of Ind.

[73] Assignee: J. I. Case Company, Racine, Wis.

[21] Appl. No.: 390,158

[22] Filed: Jun. 21, 1982

[51] Int. Cl.[3] ..... B66C 23/00

[52] U.S. Cl. ..... 414/697; 414/706

[58] Field of Search ..... 414/697, 706–713, 414/719

[56] References Cited

U.S. PATENT DOCUMENTS

| | | | |
|---|---|---|---|
| 2,811,265 | 10/1957 | Wagner | 414/711 X |
| 3,180,504 | 4/1965 | Gruben et al. | 414/711 X |
| 3,730,362 | 5/1973 | Hurlburt et al. | 414/697 |

*Primary Examiner*—Robert J. Spar
*Assistant Examiner*—Donald W. Underwood
*Attorney, Agent, or Firm*—Cullen, Sloman, Cantor, Grauer, Scott & Rutherford

[57] ABSTRACT

A self-leveling linkage assembly for maintaining a bucket in a level condition and for preventing the bucket from being rolled rearwardly beyond a predetermined maximum rollback position as the lift arm for the bucket is moved to an extreme raised position. The self-leveling linkage assembly includes a control arm rotatably mounted to a tractor frame at a location forwardly of the lift arm pivot, a position link connected between the control arm and bucket, a control valve for actuating a bucket cylinder, and a linkage connected between the control valve and a manually operable control handle. If the bucket rolls back beyond a predetermined position, the position link causes the control arm to rotate which in turn actuates the control valve for the bucket cylinder thereby rolling the bucket to a level position. When the hydraulic system is inoperative and the lift arm is left in an extreme raised position, a portion of the control arm is adapted for engagement with the lift arm pivot to resist movement of the bucket rearwardly thereby preventing damage to the self-leveling linkage elements. Further, a spring relief assembly is provided in the control valve linkage to prevent the operator from interfering with the operation of the self-leveling linkage assembly.

3 Claims, 5 Drawing Figures

SELF-LEVELING LINKAGE ASSEMBLY FOR MATERIAL HANDLING EQUIPMENT

BACKGROUND OF THE INVENTION

The present invention relates generally to material handling equipment and more particularly to an improved self-leveling linkage for controlling the position of a bucket supported on a boom.

In conventional earth moving equipment, such as bucket loaders, one or more lift arms are pivotally carried on a tractor with a bucket pivoted on the free end of the lift arms. Generally, the lift arms are raised and lowered on the tractor by a hydraulic cylinder having fluid supplied thereto through a control valve while the bucket is pivoted on the end of the lift arms through an additional hydraulic cylinder having fluid supplied thereto through a further control valve.

In normal operation, the bucket is positioned in a "dig" position and is forced into a pile of material by forward movement of the tractor. The bucket is then pivoted or rolled back on the boom or lift arms for the tractor with sufficient force to break out the mass of material within the bucket from the remainder of the pile. Subsequently, the lift arms are elevated a sufficient distance to raise the bucket above the ground and the tractor is driven to some other location. Upon reaching the subsequent location, the bucket is pivoted to a "dumping" position where the contents are discharged, after which the operation is repeated.

In an operation such as this, it is important that the bucket be maintained at a "level position" while the tractor is driven from the first location to the second to prevent the material or contents from being spilled. While various self-leveling control mechanisms have been proposed for preventing the bucket from being pivoted beyond a predetermined maximum roll-back position or for maintaining the bucket at a level position, there are problems associated with the devices heretofore known.

For example, if the tractor is inoperative with the lift arms in the raised position, hydraulic fluid leakage may occur both in the bucket cylinder and loader control valve. Since the center of gravity of a leveled loader bucket in the raised position is normally rearward of the bucket pivot, the bucket will rollback when the hydraulic system is inoperative and leakage occurs. With known self-leveling linkage assemblies, this has resulted in bent or ruined linkage elements. Thus, there has been a need for an improved self-leveling linkage assembly which overcomes the problems associated with prior constructions.

SUMMARY OF THE INVENTION

The self-leveling and anti-rollback linkage assembly of the present invention includes a main control arm which is rotatably mounted to the tractor frame forwardly of the lift arm pivot shaft. A bucket position linkage is connected between the control arm and bucket for sensing the bucket position. If the bucket rolls back beyond a predetermined position, the bucket position linkage causes the control arm to rotate which in turn actuates a control valve and bucket cylinder for rotating the bucket forwardly. The self-leveling linkage controls the bucket cylinder to roll out the bucket at a rate that keeps its side cutting edge parallel to the ground as the lift arm is being raised.

The control valve for the self-leveling linkage assembly includes a rotatable control handle and a valve spool for controlling the actuation of the bucket cylinder to roll or tilt the bucket appropriately for self-leveling. A spring relief assembly is mounted along the linkage cnnecting the control handle and valve spool to prevent damage to the self-leveling linkage assembly when an operator applies more pressure to the control handle than required for normal actuation of the associated valve spool.

In operation, if the operator applies an upward pressure on the spring relief assembly which is greater than the normal valve spool actuating pressure, the relief assembly prevents damage to the self-leveling linkage and also prevents the operator from overpowering the self-leveling linkage.

If the tractor is parked or inoperative with the lift arm in an extreme raised position, normal fluid leakage both in the control valve and bucket cylinder will permit some rearward rollback of the bucket. Since the hydraulic system is also inoperative, the bucket position link pushes a portion of the rotatable control arm back against the lift arm pivot. When the control arm portion engages the lift arm pivot, the bucket position link between the control arm and bucket resists further movement of the bucket thereby preventing damage to the self-leveling linkage elements and control valve. Thus, the rotatable control arm acts like a mechanical stop against bucket rollback when the tractor is inoperative and the lift arm is raised.

Sufficient clearance is provided between the control arm portion and the lift arm pivot to permit normal operation. The clearance matches the allowable deflection in the linkage between the rotatable control arm and the control valve. When the clearance is used up between the control arm portion and lift arm pivot in response to rearward bucket creep, the self-leveling linkage will still not reach a material yield condition, and therefore, no damage occurs. Thus, the control arm and bucket position link act as a spring for storing the energy of the rolled back bucket. When the tractor is restarted, the stored energy in the control arm and bucket position link is released which causes the control valve to be actuated for returning the bucket to a level position without any damage to the linkage.

Other advantages and meritorious features of the self-leveling linkage assembly of the present invention will be more fully understood from the following description of the preferred embodiment, the appended claims, and the drawings, a brief description of which follows.

DETAILED DESCRIPTION OF THE INVENTION

Figure 1:
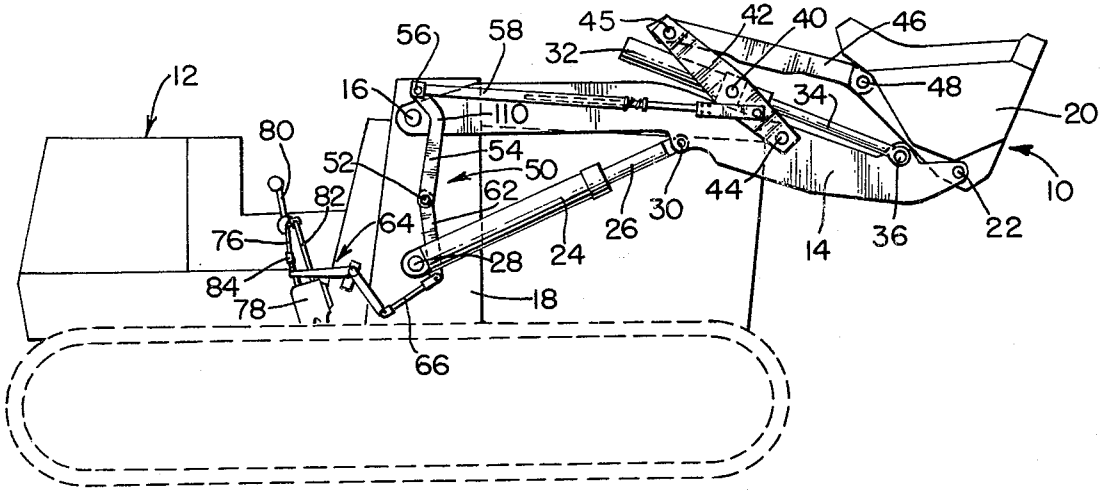
FIG. 1 is a side elevational view of a tractor including the self-leveling linkage assembly of the present invention.
Figure 2:
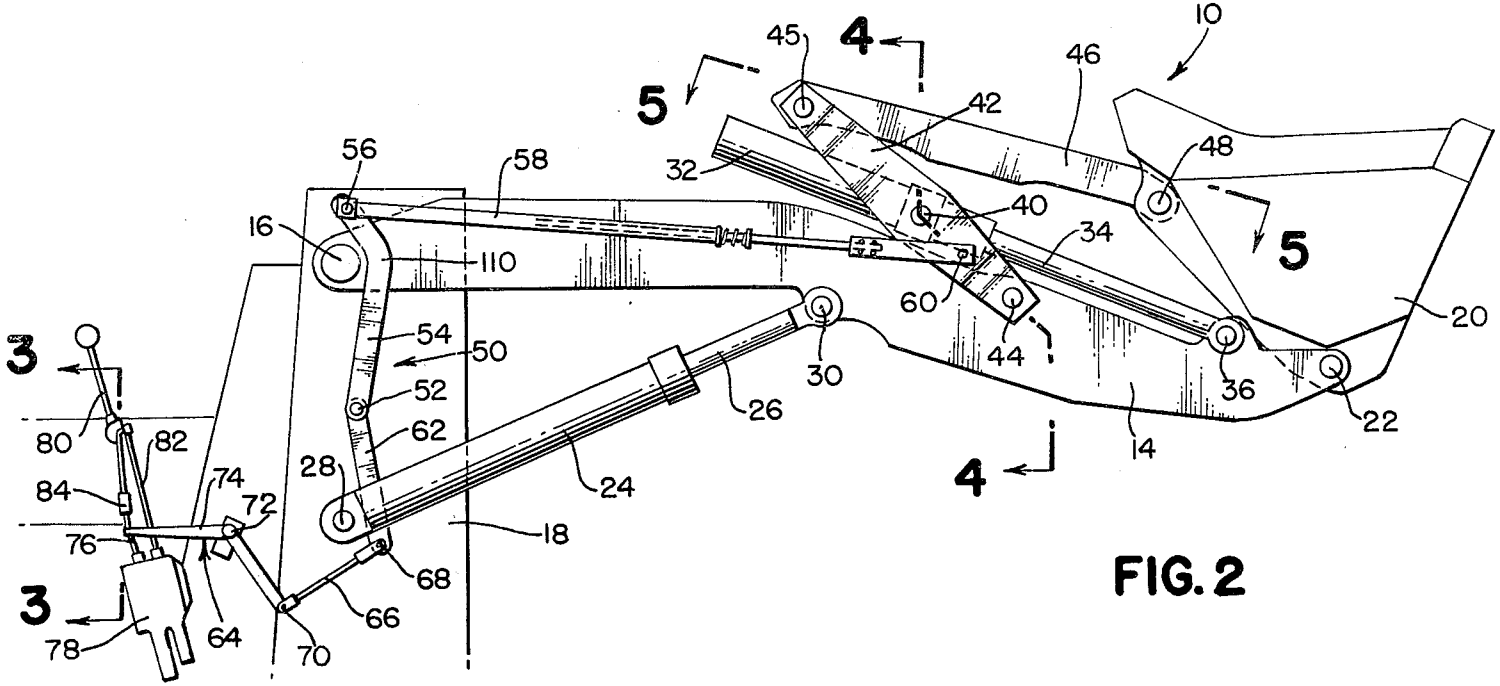
FIG. 2 is an enlarged side elevational view of the self-leveling linkage assembly.
Figure 3:
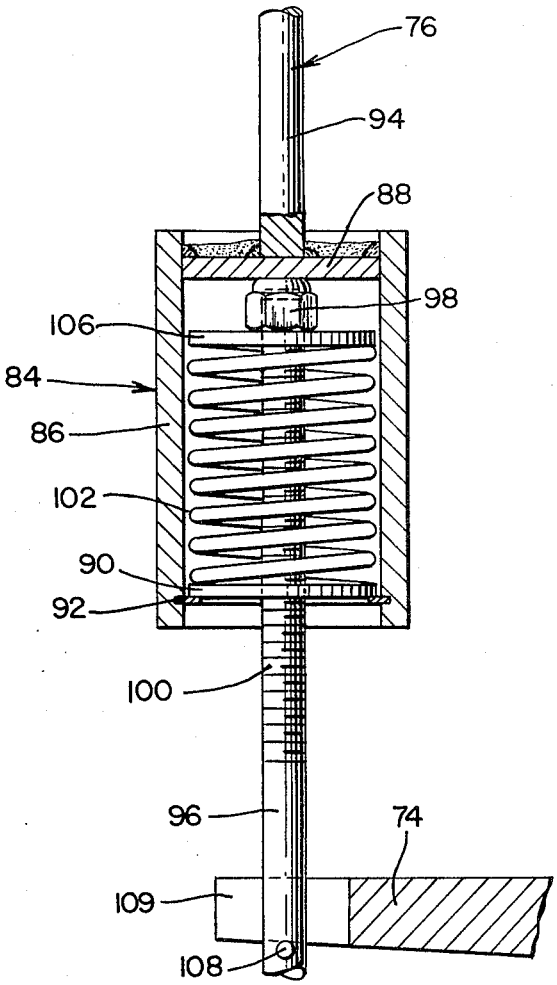
FIG. 3 is a side elevational view, partly in cross-section, of the spring relief assembly as viewed along line 3—3 in FIG. 2.

Referring to FIGS. 1 and 2, there is shown a material handling mechanism 10 mounted on a tractor 12. Material handling mechanism 10 includes a lift arm or boom 14 pivotally supported at one end to tractor frame 18 by means of a pivot shaft 16. A bucket 20 is pivotally supported at the other end of the boom or lift arm 14 by means of a pivot pin 22.

Lift arm 14 is pivoted about the pivot shaft 16 by operation of hydraulic cylinder 24 through extension or retraction of a piston rod 26. The lower end of the lift arm cylinder 24 is pivotally connected to tractor frame 18 by pin 28 while the outer end of lift arm cylinder piston rod 26 is pivotally secured to an intermediate portion of the lift arm 14 by pin 30. While only one lift arm 14 and one lift cylinder 24 are shown, it will be appreciated that lift arms and lift cylinders are located on opposite sides of tractor 12.

Figure 4:
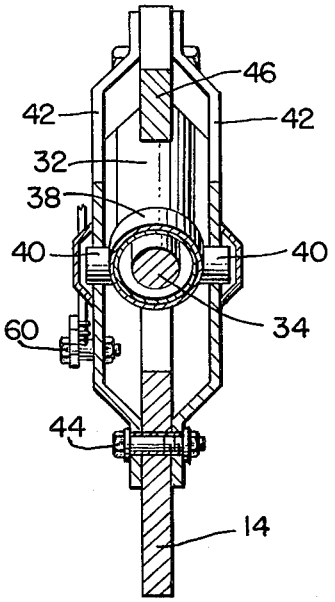
FIG.4 is a cross-sectional view taken along line 4—4 in FIG. 2.
Figure 5:
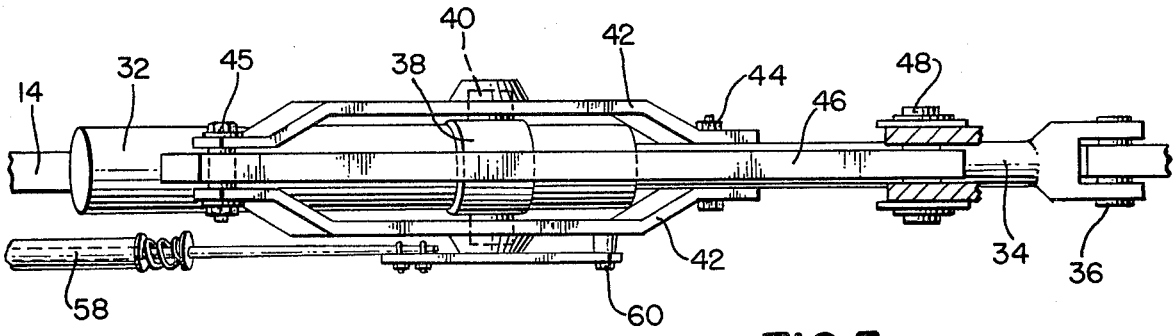
FIG. 5 is a top plan view taken along line 5—5 in FIG. 2.

The pivotal movement of bucket 20 about pin 22 is controlled by hydraulic bucket cylinder 32 having a piston rod 34 pivotally connected by pin 36 to lift arm 14 and a cylinder trunnion 38 (FIG. 4) mounted by pin 40 on links 42. Links 42 form part of a compound linkage, and they are pivotally connected by pin 44 to lift arm 14 while their opposite ends are pivotally connected by pin 45 to a second link 46 which in turn is pivotally connected to bucket 20 by pin 48.

Application of hydraulic pressure to the rod end of bucket cylinder 32 causes bucket 20 to pivot forwardly relative to lift arm 14 from a carry position where the top of the bucket is substantially level with the ground through a dig position into a dump position. Conversely, application of hydraulic pressure to the piston end of cylinder 32 causes bucket 20 to pivot in a reverse direction from the dump position through the dig to the carry position. In most instances, it is desireable to maintain the bucket in a level condition as shown in FIGS. 1 and 2 and to prevent the bucket from being rolled back beyond a predetermined maximum rollback position when the lift arm 14 is maneuvered to an extreme raised position.

The self-leveling and anti-rollback linkage of the present invention includes a main control arm 50 which is rotatably mounted to tractor frame 18 by pin 52. Control arm 50 includes an anti-rollback portion 54 which is pivotally connected by pin 56 to one end of bucket position link 58. The other end of bucket position link 58 is connected to one of the links 42 by pin 60. Control arm portion 62 is connected to bellcrank 64 by means of link-66 and pin connections 68 and 70. Bellcrank 64 is rotatably mounted to tractor frame 18 by pin 72 and includes an arm portion 74 which is connected to control valve linkage 76.

Control valve 78 includes the linkage 76 which is connected between a rotatable control handle 80 and a valve spool (not shown) within its housing for controlling the actuation of bucket cylinder 32 to roll or tilt bucket 20 appropriately for self-leveling. A second linkage 82 is connected between rotatable control handle 80 and a second valve spool (not shown) for controlling lift arm cylinder 24 for raising and lowering lift arm 14. A spring relief assembly 84 is mounted along linkage 76 to prevent damage to the self-leveling linkage by an operator who applies more pressure to control handle 80 than required for normal actuation of the associated valve spool.

Spring relief assembly 84 includes a cylindrical housing 86 having a plate member 88 fixed to one of its ends and a plate member 90 held at its other end by ring retainer 92. A rod member 94 is connected to control valve handle 80 at one end and is secured at its other end to plate member 88. A rod member 96 is connected at one end to the control valve spool (not shown) within control valve 78 which controls bucket cylinder 32 and its other end is connected to an adjustable bearing member 98. Rod member 96 includes a threaded end portion 100 and the adjustable bearing member 98 which bears against the underside of plate member 88. Compression spring 102 is sandwiched between plate members 106 and 90 and the preload on spring 102 is set by adjusting bearing member 98 on threaded end portion 100. Rod member 96 includes a cross pin 108 which engages the underside of arm portion 74 during upward movement. Rod member 96 is slidable through the slotted end 109 of arm portion 74 during downward movement.

In operation, if the operator applies upward pressure on member 94 which is greater than normal valve spool actuating pressure, spring 108 is compressed which prevents damage to the self-leveling linkage and also prevents the operator from overpowering the self-leveling linkage. Downward pressure on rod member 94 is directly transmitted to rod member 96 since bearing member 98 is in contact with plate member 88.

The operation of the self-leveling linkage will now be described in more detail. The location of bucket 20 is sensed by bucket position link 58 which rotates control arm 50 about pivot 52. In most instances, it is desireable to maintain bucket 20 in a level position as shown in FIGS. 1 and 2 and to prevent the bucket from rolling back beyond a predetermined rollback position when the lift arm 14 is raised to an extreme position. If bucket 20 rolls back beyond the position shown on FIGS. 1 and 2, position link 58 causes control arm 50 to rotate which in turn rotates bellcrank 64 for displacing linkage 76. The movement of linkage 76 actuates control valve 78 for retracting cylinder 32 thereby rolling bucket 20 forwardly. The self-leveling linkage controls bucket cylinder 32 to roll out bucket 20 at a rate that keeps its cutting edge parallel to the ground as lift arm 14 is being raised.

If tractor 12 is parked or inoperative with lift arm 14 in an extreme raised position, the normal fluid leakage both in control valve 78 and bucket cylinder 32 will permit some rearward rollback of bucket 20. Since the hydraulic system is inoperative, the bucket position link 58 pushes the anti-rollback portion 54 of control arm 50 back against lift arm pivot 16. Anti-rollback arm portion 54 is positioned forwardly of pivot 16 and includes a bent section 110 that can engage pivot shaft 16 under the circumstances just described. Alternatively, a stop plate (not shown) may be mounted on control arm portion 54 adjacent to bent section 110 for engaging pivot shaft 16. When control arm portion 54 engages pivot 16, the connecting or position link 58 between control arm 50 and bucket 20 resists further movement of the bucket thereby preventing damages to the self-leveling linkage elements and control valve 78. Thus, control arm portion 54 acts like a mechanical stop against bucket rollback when the tractor is inoperative and the lift arm 14 is raised.

Sufficient clearance is provided between control arm portion 54 and pivot shaft 16 to permit normal operation of the self-leveling linkage. The clearance matches the allowable deflection in the linkage between control arm 50 and control valve 78. When the clearance is used up between control arm portion 54 and pivot shaft 16 in response to rearward bucket creep, the self-leveling linkage will still not reach a material yield condition, and therefore, no damage to the linkage occurs. Thus, control arm portion 54 and position link 58 acts as a spring storing the energy of the rolled back bucket 20. When the tractor is restarted, the stored energy and control arm portion 54 and position link 58 is released which causes control valve 78 to be actuated for returning bucket 20 to a level position without any damage to the linkage.

The spring relief assembly 84 is provided in control valve linkage 76 to prevent the operator from interfering with the operation of the self-leveling linkage. If the operator rotates the control handle 80 to apply a pressure on rod member 94 which is greater than normal valve spool actuation pressure, spring 102 is compressed which prevents the operator from overpowering the self-leveling linkage.

It will be apparent to those skilled in the art that the foregoing disclosure is exemplary in nature rather than limiting, the invention being limited only by the appended claims.

We claim:

1. In a material handling mechanism including at least one lift arm, pivot means securing said lift arm to a frame, a bucket pivotally supported on said lift arm, a lift cylinder for raising and lowering said lift arm, and a bucket cylinder for rolling said bucket forwardly or rearwardly relative to said lift arm, the improvement comprising:

a self-leveling linkage assembly for maintaining the bucket in a level condition and for preventing the bucket from being rolled rearwardly beyond a predetermined maximum rollback position as the lift arm is moved to an extreme raised position, said self-leveling linkage assembly including a control arm rotatably mounted to said frame at a location forwardly of said lift arm pivot means, a position link connected between said control arm and said bucket, a control valve for actuating said bucket cylinder and said control valve including a linkage connected to a manually operable control handle, means for connecting said rotatable control arm to said control valve linkage, and said rotatable control arm including an anti-rollback portion which is engagable with said lift arm pivot means to act as a mechanical stop against bucket rollback beyond a predetermined maximum rollback position for preventing damage to said self-leveling linkage assembly.

2. The material handling mechanism as defined in claim 1 including a spring relief assembly mounted to said control valve linkage for preventing damage to said self-leveling linkage assembly when an operator applies more pressure to said control handle than is required for normal actuation of said control valve.

3. The material handling mechanism as defined in claim 2 wherein said spring relief assembly includes a housing having a first plate member fixed to one of its ends and a second plate member held at its other end by retainer means, a first member connected between said control handle and said first plate member, a second member connected between said second plate member and said control valve, and a compressible spring means mounted between said plate member which is deflected when more pressure is applied to said members than is required for normal actuation of said control valve.

* * * * *